US006398438B1

(12) United States Patent
Kim et al.

(10) Patent No.: US 6,398,438 B1
(45) Date of Patent: Jun. 4, 2002

(54) SHEET FEEDING TECHNIQUE FOR IMAGE FORMING APPARATUS

(75) Inventors: Soo-Hyun Kim; Moo-Duck Kim, both of Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/302,429

(22) Filed: Apr. 30, 1999

(30) Foreign Application Priority Data

Apr. 30, 1998 (KR) ..... 98-15725
Apr. 30, 1998 (KR) ..... 98-15727
Apr. 30, 1998 (KR) ..... 98-15728

(51) Int. Cl.[7] ..... B41J 13/10

(52) U.S. Cl. ..... 400/624; 400/319; 400/356; 400/629; 347/104

(58) Field of Search ..... 400/185, 314, 400/315, 319, 320, 320.1, 355, 356, 624, 625, 628, 629; 271/22, 118, 126, 147, 160; 347/104, 105

(56) References Cited

U.S. PATENT DOCUMENTS 4,023,792 A * 5/1977 Punnett et al. ..... 271/22
4,319,740 A * 3/1982 Ulseth ..... 271/22
4,958,950 A * 9/1990 Kobayashi et al. ..... 400/624
5,000,594 A * 3/1991 Beehler et al. ..... 400/624
5,090,827 A * 2/1992 Hirano et al. ..... 400/185
5,152,622 A * 10/1992 Rasmussen et al. ..... 400/624
5,153,738 A * 10/1992 Stemmle ..... 400/185
5,380,106 A * 1/1995 West ..... 400/185
5,386,983 A * 2/1995 Ando ..... 271/118
5,419,543 A * 5/1995 Nakamura et al. ..... 400/624
5,971,641 A * 10/1999 Looney ..... 400/624
6,056,461 A * 5/2000 Yun ..... 400/624

* cited by examiner

*Primary Examiner*—Stephen R. Funk
(74) *Attorney, Agent, or Firm*—Robert E. Bushnell, Esq.

(57) ABSTRACT

A sheet feeding apparatus for an image forming apparatus comprises a carriage with which an ink-cartridge is mounted and which is reciprocated to print an image includes: a printing stroke section in which the carriage is reciprocated to print an image; a feeding stroke section which is extended to one side of the printing stroke section and into which the carriage is moved whenever it is necessary to feed a new sheet; a feeding power converting unit which is disposed in a passage of the carriage in the feeding stroke section and is rotated by being in contact with the carriage; a crankshaft which is rotated in forward and reverse rotational directions corresponding to the rotational directions of the feeding power converting unit; a paper loader one end which is rotatably disposed with respect to a hinge shaft which is apart from and faced with the crankshaft, and having another end which is a free end; and a sheet feeding unit which is provided in at least two parts of the crankshaft and which raises the free end of the paper loader so as to generate a first feeding pressure against a feeding roller and which forcibly presses a presser for generating a second feeding pressure in order.

37 Claims, 9 Drawing Sheets

SHEET FEEDING TECHNIQUE FOR IMAGE FORMING APPARATUS

CLAIM OF PRIORITY

This application makes reference to, incorporates the same herein, and claims all benefits accruing under 35 U.S.C. §119 from three applications for SHEET FEEDING APPARATUS AND METHOD FOR IMAGE FORMING MACHINE earlier filed in the Korean Industrial Property Office on the Apr. $30^{th}$, 1998 and there duly assigned Ser. No. 15725/1998, for SHEET FEEDING APPARATUS AND METHOD FOR IMAGE FORMING MACHINE earlier filed in the Korean Industrial Property Office on the Apr. $30^{th}$, 1998 and there duly assigned Serial No. 15727/1998, and for SHEET FEEDING APPARATUS AND METHOD FOR IMAGE FORMING MACHINE earlier filed in the Korean Industrial Property Office on the Apr. $30^{th}$, 1998 and there duly assigned Serial No. 15728/1998.

BACKGROUND OF THE INVENTION

1. Field of the Invention

The present invention relates to an image forming apparatus such as an ink-jet printer, and more particularly, to a sheet feeding technique for an image forming apparatus using a movement of a carriage as a driving power source, with which an ink-cartridge is mounted and which is reciprocated on a paper to print an image, in order to automatically feed a single sheet of paper on a printing apparatus of the image forming apparatus.

2. Description of the Related Art

Generally, papers are used in an image forming apparatus such as an ink-jet printer and facsimile machine, and so forth. The image forming apparatus is provided with a sheet feeding apparatus including a paper separating unit for feeding single sheets of paper.

The paper separating unit can be classified into two types. One is a finger type unit which employs a finger member for separating the papers, and the other is a pad type unit which employs a friction pad for separating the papers. However, in both types of units, a separate device, such as a cam, is provided so that the units operate by themselves.

In the paper separating unit for separating and feeding single sheets of paper, as mentioned to above, the finger type unit is mainly used, since its structure is comparatively simple. However, the finger type unit has a problem is that its accuracy in separating the papers into a single sheet is relatively low. This problem results in a sheet feeding error by feeding two or more sheets of paper, thereby causing a paper jam in the image forming apparatus.

In addition, the pad type unit has a problem in that, since the unit itself must have a separate driving means, the structure thereof is very complex and further the cost is high.

Moreover, an image forming apparatus such as an ink-jet printer employs a sheet feeding mechanism which is a top loading type or a return type according to the paper loading arrangement. However, these types of sheet feeding mechanisms must be provided with a spring or a motor for feeding papers, thereby causing printing errors due to sheet feeding errors and an increase in the manufacturing cost.

SUMMARY OF THE INVENTION

It is therefore an object of the present invention to provide an improved sheet feeding technique for separating and feeding single sheets of paper using a driving power source contained within the image forming apparatus itself.

It is another object of the present invention to provide an improved sheet feeding apparatus having a simplified and compact structure to control a sheet feeding pressure with a driving power source provided within the image forming apparatus itself.

To achieve the above objects and other advantages, there is provided a sheet feeding apparatus for an image forming apparatus having a carriage with which an ink-cartridge is mounted and which is reciprocated to print an image, the sheet feeding apparatus comprising: a printing stroke section in which the carriage is reciprocated to print an image; a feeding stroke section which is extended to one side of the printing stroke section and into which the carriage is moved whenever it is necessary to feed a new sheet; a feeding power converting unit which is disposed in a passage of the carriage in the feeding stroke section and is rotated by being in contact with the carriage; a crankshaft which is rotated in forward and reverse rotational directions corresponding to the rotational directions of the feeding power converting unit; a paper loader having one end which is rotatably disposed with respect to a hinge shaft which is apart from and faced with the crankshaft, and having another end of which is a free end; and a sheet feeding unit which is provided in at least two parts of the crankshaft and which raises the free end of the paper loader so as to generate a first feeding pressure against a feeding roller and which forcibly presses a presser for generating a second feeding pressure in order.

Further, according to the present invention, there is provided a sheet feeding method for an image forming apparatus, the method comprising the steps of: moving a carriage, in which an ink-cartridge is mounted, to a feeding stroke section; detecting whether the carriage is still moving to the feeding stroke section; determining whether a feeding power converting unit is being driven; determining whether the movement of the carriage in the feeding stroke section has completely stopped; determining whether there is a signal for a printing operation; and feeding a sheet and performing the printing operation.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

The present invention now will be described more fully hereinafter with reference to the accompanying drawings, in which preferred embodiments of the invention are shown.

First of all, in order to explain sheet feeding techniques of the image forming apparatus according to the present invention, this invention is embodied in a sheet feeding apparatus of an ink-jet printer as an example.

Figure 1:
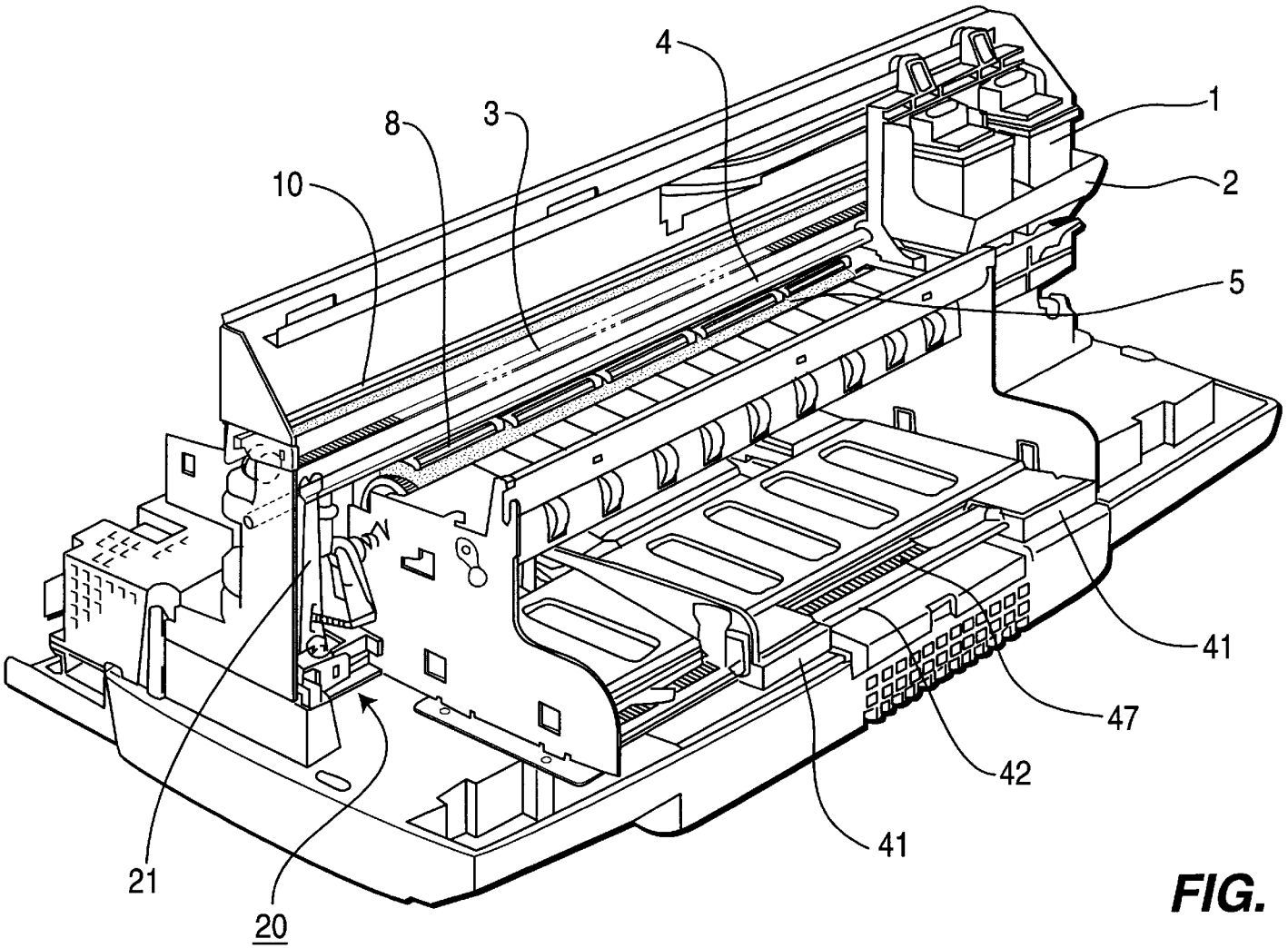
FIG. 1 is a perspective view showing an inner portion of an ink-jet printer having a sheet feeding apparatus according to the present invention.

FIG. 1 shows the sheet feeding apparatus of the ink-jet printer. The ink-jet printer comprises a carriage 2, a driving motor(not shown) for driving the carriage 2, a timing belt 3, and a guide shaft 4. The carriage 2 is provided with an ink-cartridge I mounted therein and is reciprocated in the right and left directions on a paper by the driving motor, thereby printing an image on the paper sheet. The sheet feeding apparatus is further provided with an encoder strip 10 each end of which is attached to the frame above the timing belt 3 and guide shaft 4.

Further, a feeding roller 5 is disposed under the paper sheet to be printed. A crankshaft 30 is disposed under the feeding roller 5 so as to be parallel with the feeding roller 5, as shown in FIG. 2.

Figure 2:
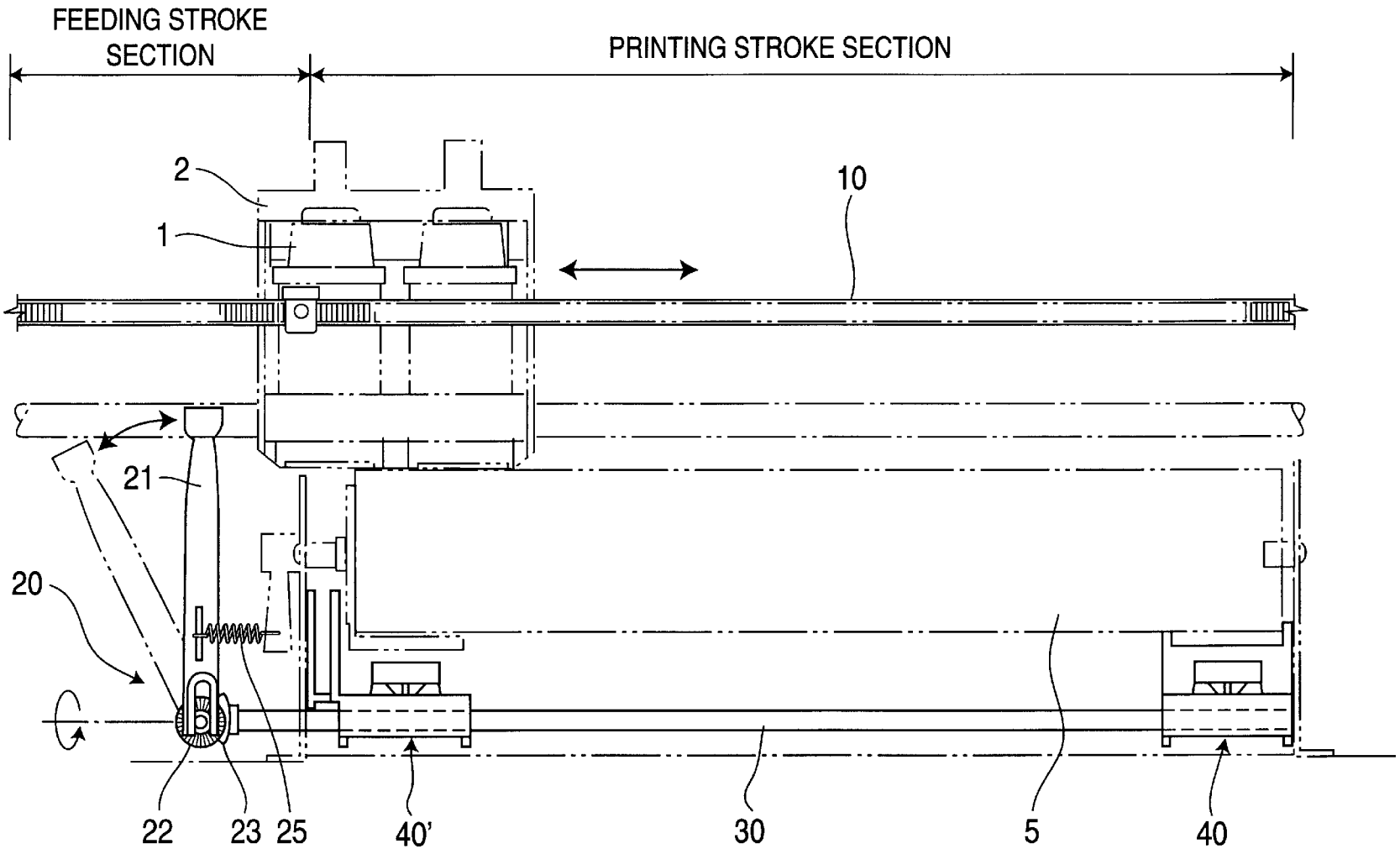
FIG. 2 is a schematic front view of the sheet feeding apparatus in FIG. 1.
Figure 5:
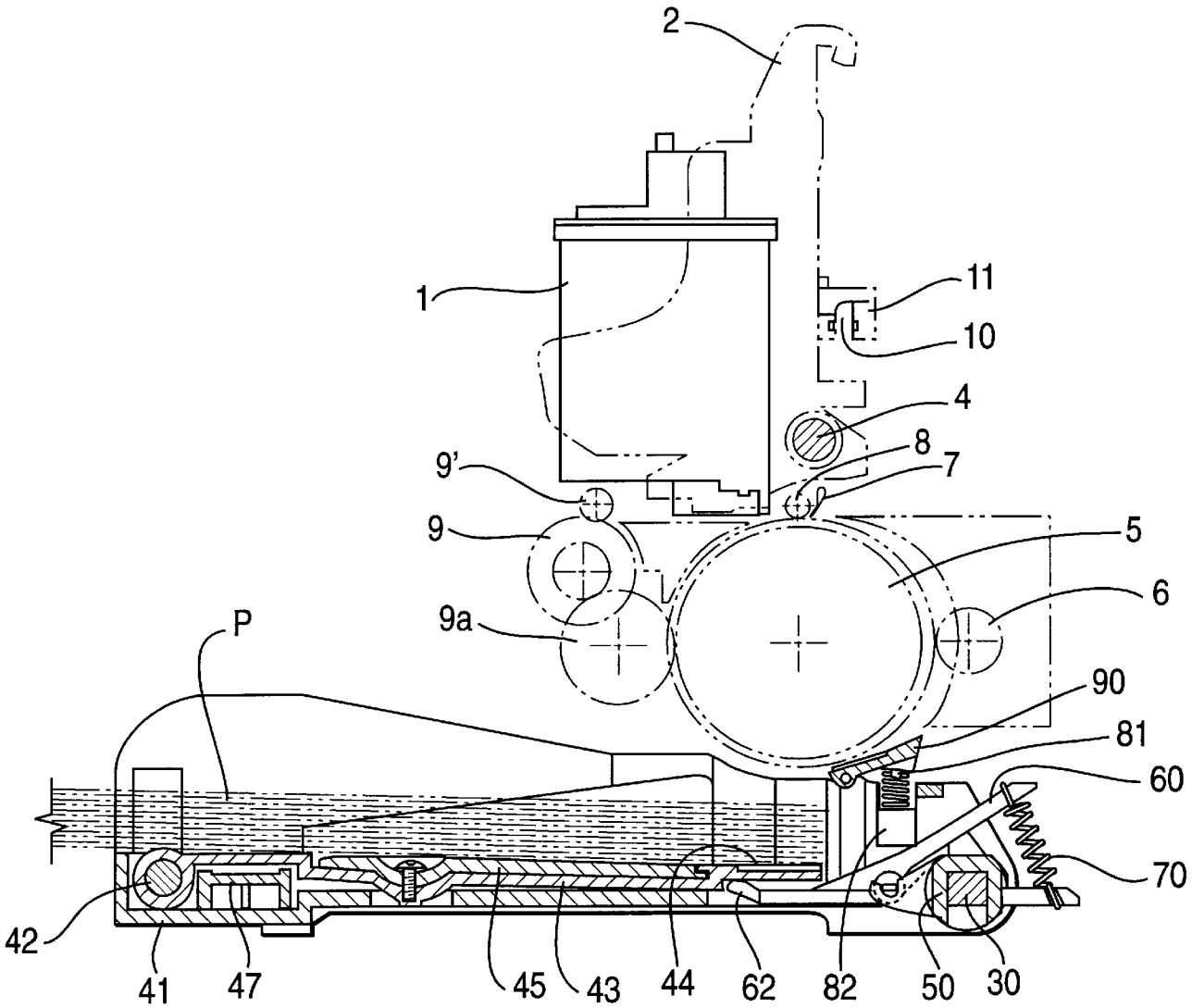
FIG. 5 is a sectional side view of the sheet feeding apparatus in FIG. 1.

As shown in FIGS. 2 and 5, a position detecting sensor 11 is mounted on a rear face of the carriage 2 so as to be opposite to the encoder strip 10. Therefore, when the carriage 2 is reciprocated, the position detecting sensor 11 detects the position of the carriage 2 from the encoder strip 10 and outputs a signal to a main circuit (not shown). As a result, the main circuit can accurately control movement of the carriage 2.

In FIG. 2, a printing stroke section indicates an area that the paper sheet to be printed is fed and an image printing is performed by the ink-cartridge 1 mounted in the carriage 2, i.e., that the feeding roller 5 is disposed. According to the present invention, the carriage 2 can be further moved to one side (left side) over the printing stroke section. This area is defined as a feeding stroke section. A feeding power converting unit 20 is mounted in the feeding stroke section. The feeding power converting unit 20 serves to transmit the feeding power generated by the carriage 2.

The crankshaft 30 receives the feeding power transmitted from the feeding power converting unit 20. Therefore, the crankshaft 30 is rotated in a forward direction or reverse direction according to the reciprocation of the carriage 2.

In addition, the crankshaft 30 may be rotated by a motor (not shown).

A rotational direction of the crankshaft 30 according to the reciprocation of the carriage 2 is determined as follows.

In FIG. 2, the carriage 2 in which the ink-cartridge 1 is mounted is reciprocated only in the printing stroke section during the printing operation. However, after the completion of the printing operation, if it is necessary to feed another paper sheet, the carriage 2 is moved into the feeding stroke section so as to operate the feeding power converting unit 20.

The feeding power converting unit 20 comprises a carriage lever 21, a driving bevel gear 22, a driven bevel gear 23 and a gear housing 24 for protecting the driving and driven bevel gears 22 and 23. An upper end of the carriage lever 21 is pushed by the carriage 2 and is rotated on a lower end of the carriage lever 21. The driving bevel gear 22 is fixedly attached to the lower end of the carriage lever 21 and is disposed rotatably along with the carriage lever 21. The driven bevel gear 23 is orthogonally engaged with the driving bevel gear 22 so that the direction of the feeding power transmitted from the carriage 2 can be converted orthogonally. The driven bevel gear 23 is directly coupled to the crankshaft 30.

Therefore, if the feeding power converting unit 20 is rotated by the carriage 2, a rectilinear motion of the carriage 2 is converted into a rotational motion by the driving and driven bevel gears 22 and 23. Thus, the crankshaft 30 is rotated by the converted rotational motion.

The relationship between the movement of the carriage 2 in the feeding stroke section and the operation of the feeding power converting unit 20 is described more fully below.

When it is necessary to feed a new paper sheet, the carriage 2 is moved from the printing stroke section into the feeding stroke section as shown in FIG. 2. At this time, the carriage 2 is moved. This movement of the carriage 2 is defined as a forward movement. During the forward movement of the carriage 2, a paper sheet is in a feeding state. The feeding state will be described later.

Meanwhile, after the forward movement, the carriage 2 is returned to the printing stroke section. This movement of carriage 2 is defined as a reverse movement. The reverse movement is divided into a first reverse movement and a second reverse movement. That is, after the completion of the forward movement of the carriage 2, the carriage 2 is firstly moved from an initial point (i.e., moved from a first position) of the reverse movement to a ⅓ point of the entire length of the feeding stroke section (i.e., moved to a second position). The carriage is stopped for a while and then secondly moved to the printing stroke section (i.e., moved to a third position). As described above, when the carriage 2 is moved in the forward and reverse directions, the position of the carriage 2 is always detected by the position sensor 11 mounted on the rear face of the carriage 2. The detecting signal of the position sensor 11 is transmitted to the main circuit. Therefore, the forward and reverse movements of the carriage 2 in the feeding stroke section are accurately controlled by the main circuit.

The carriage lever 21 is rotated in forward and reverse rotational directions according to the forward and reverse movement of the carriage 2. Thus, if the carriage 2 is moved in the forward direction, the carriage lever 21 is also rotated in the forward rotational direction. If the carriage 2 is firstly and secondly moved in the reverse direction, the carriage lever 21 is firstly and secondly rotated in the reverse rotational direction corresponding to the movement of the carriage 2. This reverse rotational movement of the carriage lever 21 is secured by an elastic member 25 attached to the carriage lever 21.

Therefore, the driving and driven bevel gears 22 and 23 of the feeding power converting unit 20 are also rotated in the forward and reverse rotational directions. Sequentially, the crankshaft 30 directly coupled to the driven bevel gear 23 is rotated in the forward and reverse rotational directions.

For a reference, in the rectilinear and rotational movements of the carriage 2 and the crankshaft via the carriage lever 21 and the driving and driven bevel gears 22 and 23, the forward and forward rotational movements mean that the first and second feeding pressures are applied in the sheet feeding apparatus according to the present invention. On the contrary, the reverse and reverse rotational movement mean that the first and second feeding pressure are released in the sheet feeding apparatus, which will be described later more fully.

In FIG. 2, the crankshaft 30 is placed in a lower portion of the feeding roller 5, and has a length extended over the whole length of the printing stroke section. Further, the crankshaft 30 is provided with at least two sheet feeding, units 40 in the printing stroke section, which are operated by a rotational force of the crankshaft 30. The sheets of paper to be fed are loaded by the sheet feeding units 40 and 40'.

Figure 3:
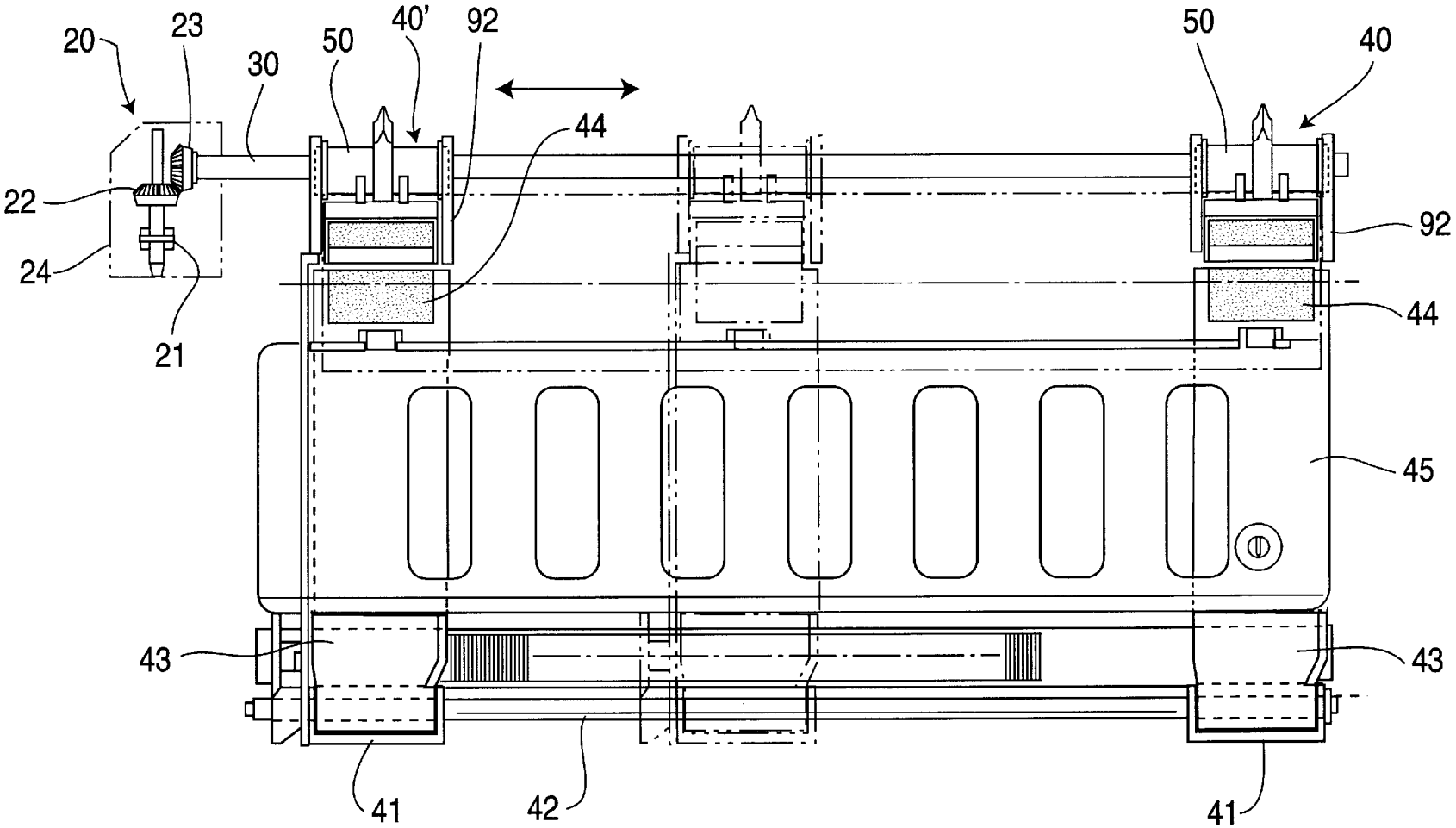
FIG. 3 is a plan view of the sheet feeding apparatus in FIG. 1.

Referring to FIG. 3, unit 40 of the sheet feeding units 40 and 40' is fixedly mounted on the crankshaft 30. The other unit 40' is mounted on the crankshaft 30 so as to be moved along the crankshaft 30. Thus, when the papers are loaded between the sheet feeding units 40 and 40', the movable sheet feeding unit 40' can be moved along the crankshaft 30 to the left or right side according to a size of the sheet.

Figure 4:
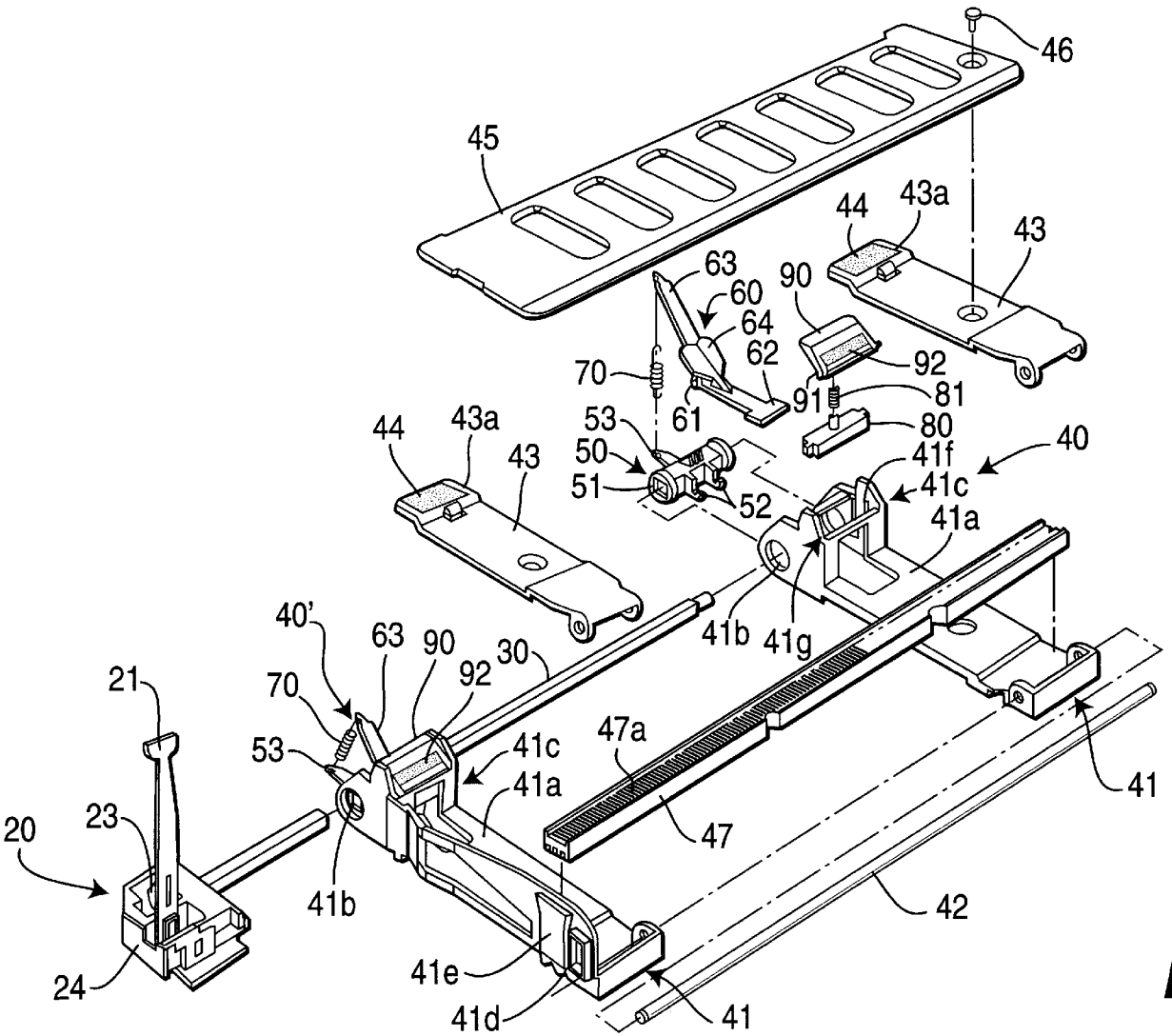
FIG. 4 is an exploded perspective view of the sheet feeding apparatus in FIG. 1.

FIGS. 4 and 5 are an exploded perspective view and an assembled sectional view showing the sheet feeding units 40 and 40'.

In FIG. 5, pad housings 41 of the sheet feeding units 40 and 40' are respectively disposed orthogonally to the crankshaft 30. The pad housing 41 is formed with an elongated body part 41*a* and a feeding motion part 41*c* provided with a through aperture 41*b*. The crankshaft 30 is disposed through the through aperture 41*b*.

Therefore, the rotational force of crankshaft 30 is applied to the pad housing 41. The pad housing 41 only serves as a housing which forms the sheet feeding unit 40 and 40'.

In addition, a knock-up plate 43 which is a portion of paper loader is mounted on the body part 41*a* of the pad housing 41. One end of the knock-up plate 43 is rotatably disposed to a hinge shaft 42 which is apart from and faced with the crankshaft 30, the other is a free end on which a first pressing pad 44 is attached.

Further, a paper supporting member 45 for loading sheets of paper is provided on both upper faces of the knock-up plates 43. The paper supporting member 45 is fixed to one of the knock-up plates 43 by a fixing means 46.

Accordingly, if the knock-up plate 43 is rotated with the hinge shaft 42 in the center so that the free end 43*a* of the knock-up plate 43 is raised, the paper supporting member 45 is also raised along with the loaded papers P.

In FIG. 4, a reference numeral 47 indicates an adjusting bar which guides the movement of the movable sheet feeding unit 40' and fixes the movable sheet feeding unit 40' at a desired position. The adjusting bar 47 is formed with a toothed part 47*a* at an upper face thereof. The adjusting bar 47 is disposed through a through aperture 41*d* of the pad housing 41. One of both of the pad housings may have a pad housing aperture which is formed to be parallel with crankshaft 30 and through which adjusting bar 47 is disposed. Adjusting bar 47 guides the movement of the movable sheet feeding unit 40' and positions movable sheet feeding unit 40' at a desired position.

As a result, the sheet feeding unit 40' can be moved to the right and left sides along the crankshaft 30. After moved to a desired position, a stopper 41*e* placed on an upper portion of the hole 41*d* is engaged with the tooth part 47*a* of the adjusting bar 47, whereby the sheet feeding unit 40' is fixed at a desired position. When it is necessary to move the sheet feeding unit 40', the stopper 41*e* is released from the tooth part 47*a* so that the sheet feeding unit 40' can be freely moved. This position adjusting of the sheet feeding unit 40' is performed according to the size of the loaded paper.

In the feeding motion part 41*c* of the pad housing 41, a lever arm 50 is disposed with respect to the crankshaft 30. The lever arm 50 in the sheet feeding unit 40 may be fixed to the crankshaft 30. However, the lever arm 50 in the movable sheet feeding unit 40' should be disposed so as to be moved with the pad housing 41 along the crankshaft 30.

According to the present invention, in order to receive the rotational force and be also moved to the right and left sides along the crankshaft 30, the lever arm 50 has a rectangular through aperture 51, and the crankshaft 30 inserted through the rectangular aperture 51 also has a rectangular shape corresponding to the rectangular aperture 51 of the lever arm 50.

By this combing structure between the crankshaft 30 and lever arm 50, the lever arm 50 can receive the rotational force from the crankshaft 30 without any other fixing means, while being moved to the right and left sides along the crankshaft 30. Of course, the movement of the lever arm 50 is performed with the movement of the pad housing 41.

The lever arm 50 is formed with a hinge boss 52 and a first protruded portion 53 at the front and rear side thereof. A hinge shaft 61 of a lift lever 60 is rotatably coupled to the hinge boss 52 of the lever arm 50.

The lift lever 60 is formed with a first pressing lever 62, a second pressing portion 64 and a second protruded portion 63 at each front, middle and rear sides thereof. The first pressing lever 62 is positioned at a bottom portion of the free end 43*a* of the knock-up plate 43 so that the first pressing lever 62 can lift up the free end 43*a* of the knock-up plate 43 when being rotated.

An elastic tension member 70 is disposed between the first and second protruded portions 53 and 63. Preferably, the elastic tension member 70 is a tension spring.

On the second pressing portion 64 of the lift lever 60, there is placed an elevating member 80. The elevating member 80 is disposed in a guiding groove 41*f*, which is formed on each of both inner sides of the feeding motion part 41*c*. The elevating member 80 is raised and lowered in the guiding groove 41*f*.

A pad holder 90 is positioned on the elevating member 80. The pad holder 90 is formed with a hinge shaft 91 which is projected from both sides of the pad holder 90 and rotatably mounted on a slot 41*g* of the feeding motion part 41*c*. Further, an elastic member 81 is disposed between the pad holder 90 and the elevating member 80 so as to elastically support the pad holder 90.

On an upper face of the pad holder 90, there is attached a second pressing pad 92 which is in contact with the feeding roller 5.

The pad holder 90 is disposed so as to be tilted against the feeding roller 5, while the hinge shaft 92 of the pad holder 90 is provided at the lower side part of the tilted pad holder 90. Thus, if the elevating member 80 is lowered, the pad holder 90 is also rotated downward by its own self-weight.

FIG. 5 shows the sheet feeding apparatus in which the paper has not been fed yet. A reference numeral 6 indicates a guiding roller; element 7 is paper detecting sensor; element 8 is a friction roller which is frictionally in contact with the feeding roller 5 and is rotated by the feeding roller 5; element 9 is a discharging roller which is rotated by a power transferring wheel 9*a,* and element 9' is a star wheel.

In FIG. 5, since the knock-up plate 43 is in contact with the pad housing 41 and the loaded paper P is apart from the feeding roller 5, the paper P can not be fed.

Figure 6:
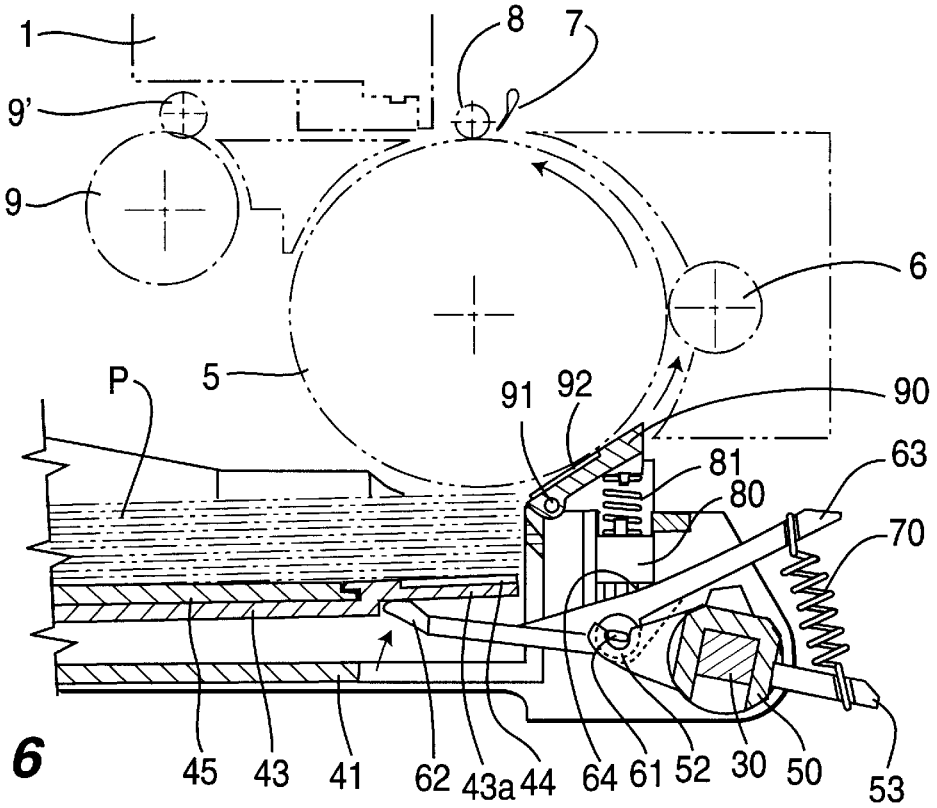
FIG. 6 is a sectional side view showing a first feeding pressure being applied in the sheet feeding apparatus in FIG. 5.
Figure 7:
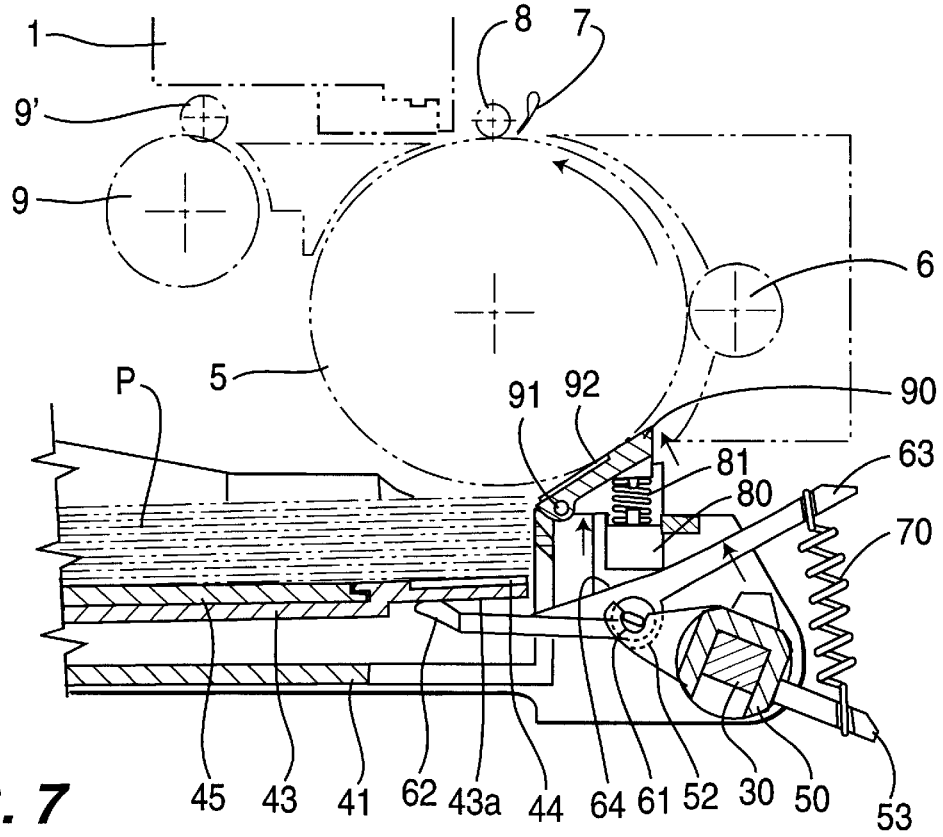
FIG. 7 is a sectional side view showing a second feeding pressure being further applied in the sheet feeding apparatus in FIG. 6.

FIGS. 6 and 7 show the first and second feeding pressures being generated by the sheet feeding unit according to the present invention.

As described above, if the forward movement of the carriage 2 is performed, the carriage is moved to the feeding stroke section. The rectilinear motion of the carriage 2 is converted into the rotational motion by the feeding power converting unit 20. Thus, the crankshaft 30 is rotated in the forward rotational direction, and the sheet feeding units 40 and 40' are operated.

In FIG. 6, the crankshaft 30 is rotated in the forward rotational direction (clockwise direction). The lever arm 50 is also rotated in the same rotational direction as that of the crankshaft 30. Therefore, the hinge boss 52 of the lever arm 50 is rotated upward with the crankshaft 30 in the a center so that the hinge shaft 61 of the lift lever 60 is raised.

As a result, the first pressing lever 62 of the lift lever 60 lifts up the free end 43*a* of the knock-up plate 43. The knock-up plate 43 is rotated with the hinge shaft 42 in the center, whereby the paper P loaded on the first pressing pad 44 of the knock-up plate 43 is in close contact with the feeding roller 5. This is the first feeding pressure being applied. The second feeding pressure is continuously applied.

That is, in this situation, although the crankshaft 30 is further rotated in the forward rotational direction, the first pressing lever 62 of the lift lever 60 can not be further raised. From then on, the lift lever 60 itself is lifted up by the lever arm 50. Therefore, the lift lever is rotated upward with the contact point of the first pressing lever 62 and the free end 43*a* of the knock-up plate 43 in the center, as shown in FIG. 7.

According to the raising of the lift lever 60, the second pressing portion 64 of the lift lever 60 is raised so that the elevating member 80 is raised along the guide groove 41*f*.

The elevating member 80 presses the elastic member 81. The pressed elastic member 81 sequentially presses the pad holder 90, the second pressing pad 92 being pressed on the feeding roller 5 (referring to FIG. 10A). This is the second feeding pressure being applied.

Strictly speaking, the first and second feeding pressures are generated in order. However, they are generated successively within a second. The first and second feeding pressures are generated while the feeding roller 5 is rotated in the forward rotational direction (counter clockwise direction). The paper sheets loaded on the first pressing pad 44 are in contact with feeding roller 5 and are fed by the first feeding pressure. The paper sheets are separated so as to be fed only a single sheet of paper at a time by the second feeding pressure.

That is, since a constant pressure is applied to the feeding roller 5 by the pad holder 90 during the second feeding pressure, only a single sheet of paper can be separated and fed.

This feeding operation continues until the paper P fed by the feeding roller 5 is in contact with the friction roller 8. When the fed paper touches the paper detecting sensor 7, the paper detecting sensor 7 outputs a signal to the main circuit so that the main circuit stops the driving of the feeding roller 5.

In this situation, the carriage 2 has completed its forward movement in the feeding stroke section. After that, the carriage 2 performs the reverse movement at once.

Therefore, the crankshaft 30 including the feeding power converting unit 20 is rotated in the reverse rotational direction. The lever arm 50 is also rotated in the reverse rotational direction. As described above, this reverse movement is divided into the first and second reverse movements. That is, after the first movement, the carriage 2 is stopped for a while and then secondly moved to the printing stroke section.

Figure 8:
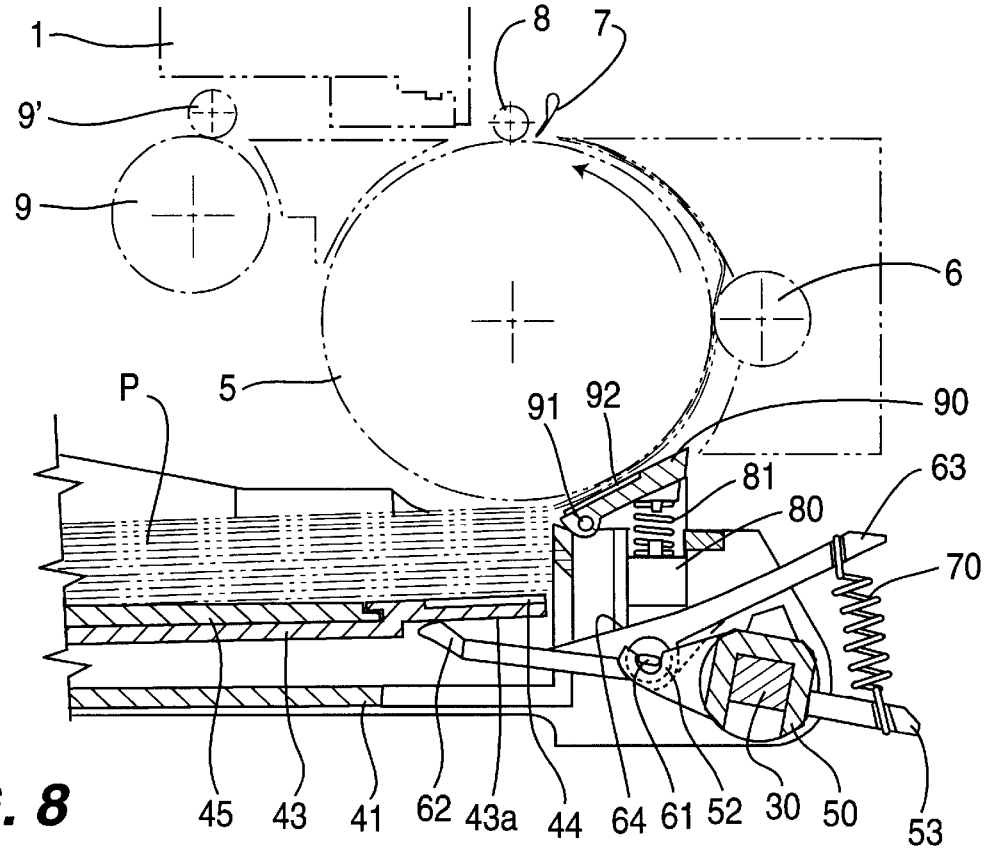
FIG. 8 is a sectional side view showing the first feeding pressure being released in the sheet feeding apparatus in FIG. 7.

FIG. 8 shows when the crankshaft 30 is firstly rotated in the reverse rotational direction. Also, the lever arm 50 is somewhat rotated in the reverse rotational direction by the crankshaft 30. However, the first pressing lever 62 of the lift lever 60 still continues to lift the knock-up plate 43. Thus, the first feeding pressure is also continued.

In other words, if the crankshaft 30 performs the first reverse movement, only the second feeding pressure is released. That is, only the second pressing portion 64 including the second protruded portion 63 of the lift lever 60 is returned down by the elastic tension member 70.

Therefore, the elevating member 80 and the elastic member 81 disposed on the elevating member 80 are moved downward. The elastic member 81 loses the pressing force against the pad holder 90, whereby the second feeding pressure is released. The second pressing pad 92 on the pad holder 90 is apart from the feeding roller 5 (referring to FIG. 10B).

At this time, the feeding roller 5 is reversely rotated in the clockwise direction. Thus, the end of the fed paper P is reversely pushed back. However, since the middle part of the fed paper P is caught by the feeding roller 5 and the guiding roller 6, the fed paper P is bent by the reverse rotation of the feeding roller 5.

After that, the bent paper P is returned by the bending force and is lined up for the friction roller 8.

Upon releasing the second feeding pressure, the reverse movement of the feeding roller 5 occurs in a moment. Immediately, the first feeding pressure is also released and the feeding roller 5 is again rotated in the forward rotational direction (counter clockwise direction).

Figure 9:
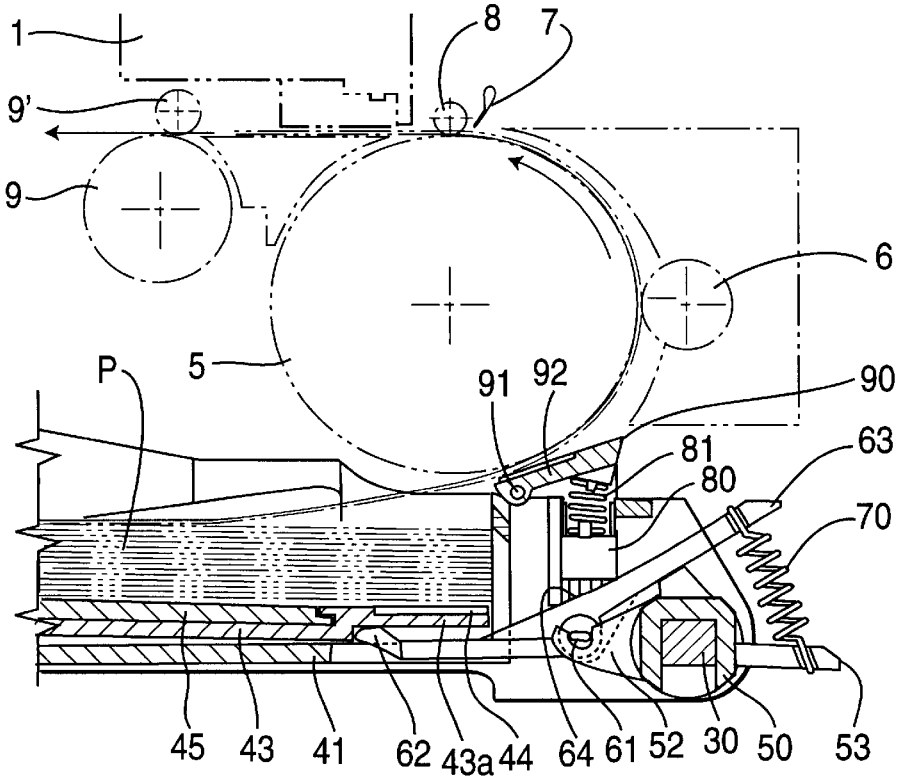
FIG. 9 is a sectional side view showing the second feeding pressure being further released in the sheet feeding apparatus in FIG. 8.

FIG. 9 shows when the first feeding pressure is released. At this time, the carriage 2 is secondly moved in the reverse direction. Also, the crankshaft 30 is secondly rotated in the reverse rotational direction.

That is, the crankshaft 30 is further rotated in the counter clockwise direction. Thus, the hinge boss 52 of the lever arm 50 is returned down so that the first pressing lever 62 of the lift lever 60 is moved down to its original position.

Therefore, the free end 43*a* of knock-up plate 43 is also moved down to the upper face of the pad housing 41. The paper loaded on the first pressing pad 44 of the knock-up plate 43 is apart from the feeding roller 5 and can not be further fed. All of the first and second feeding pressures are released, and the fed paper sheet caught by the feeding roller 5 and friction roller 8 is printed by the ink-cartridge 1 mounted in the carriage 2 which is reciprocated in the printing stroke section.

Then, after completion of the printing operation, if it is necessary to feed a new paper, the first and second feeding pressures are again generated by the carriage 2 so that only a new paper sheet is separated and fed. The second and first feeding pressures are controlled to be released in order.

Figure 10A:
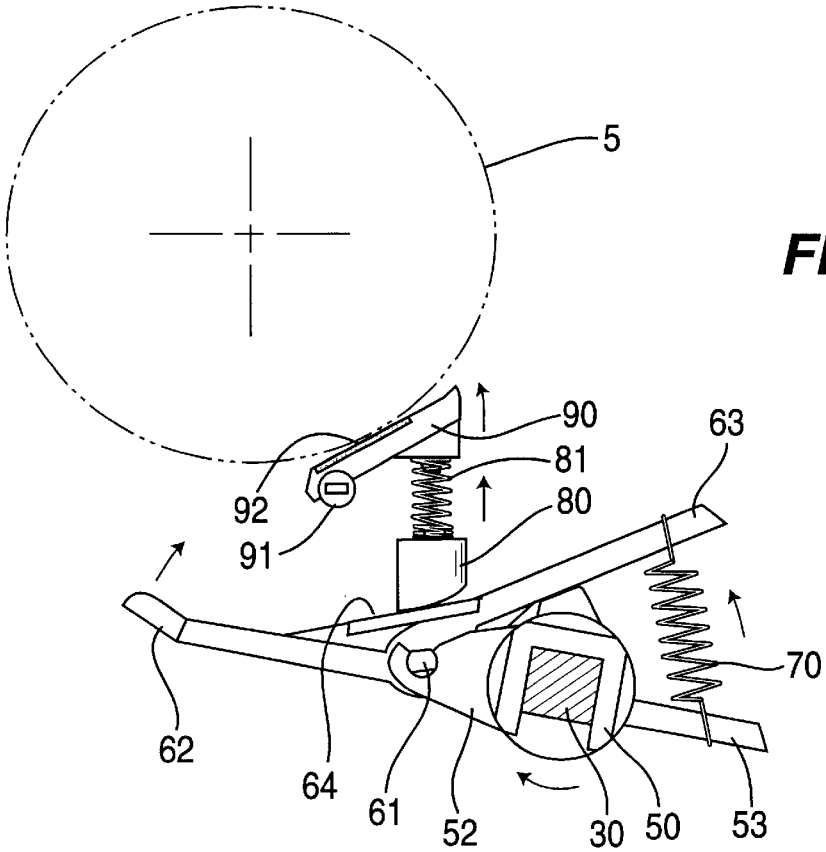
FIGS. 10A and 10B are sectional side views showing the second feeding pressure being applied or released in the sheet feeding apparatus according to the present invention.
Figure 10B:
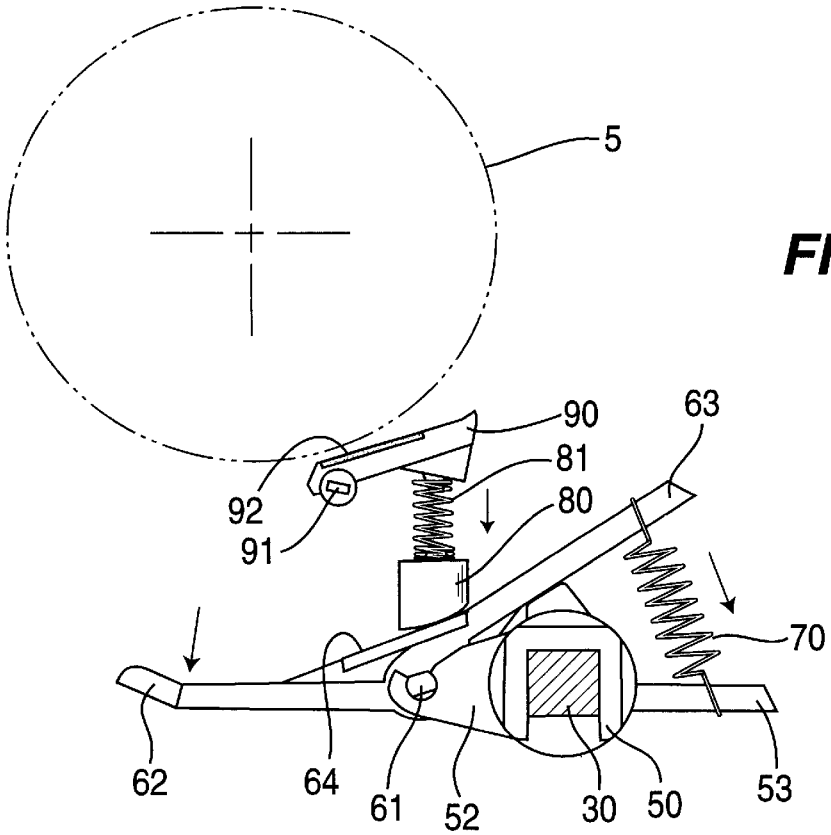

In addition, after the paper separating operation is completed by the second feeding pressure, the pad holder 90 is controlled to be apart from the feeding roller 5 as shown in FIG. 10A. In this situation, even the first feeding pressure is also controlled to be released, whereby the fed paper is fed and printed without any feeding pressure.

Figure 11:
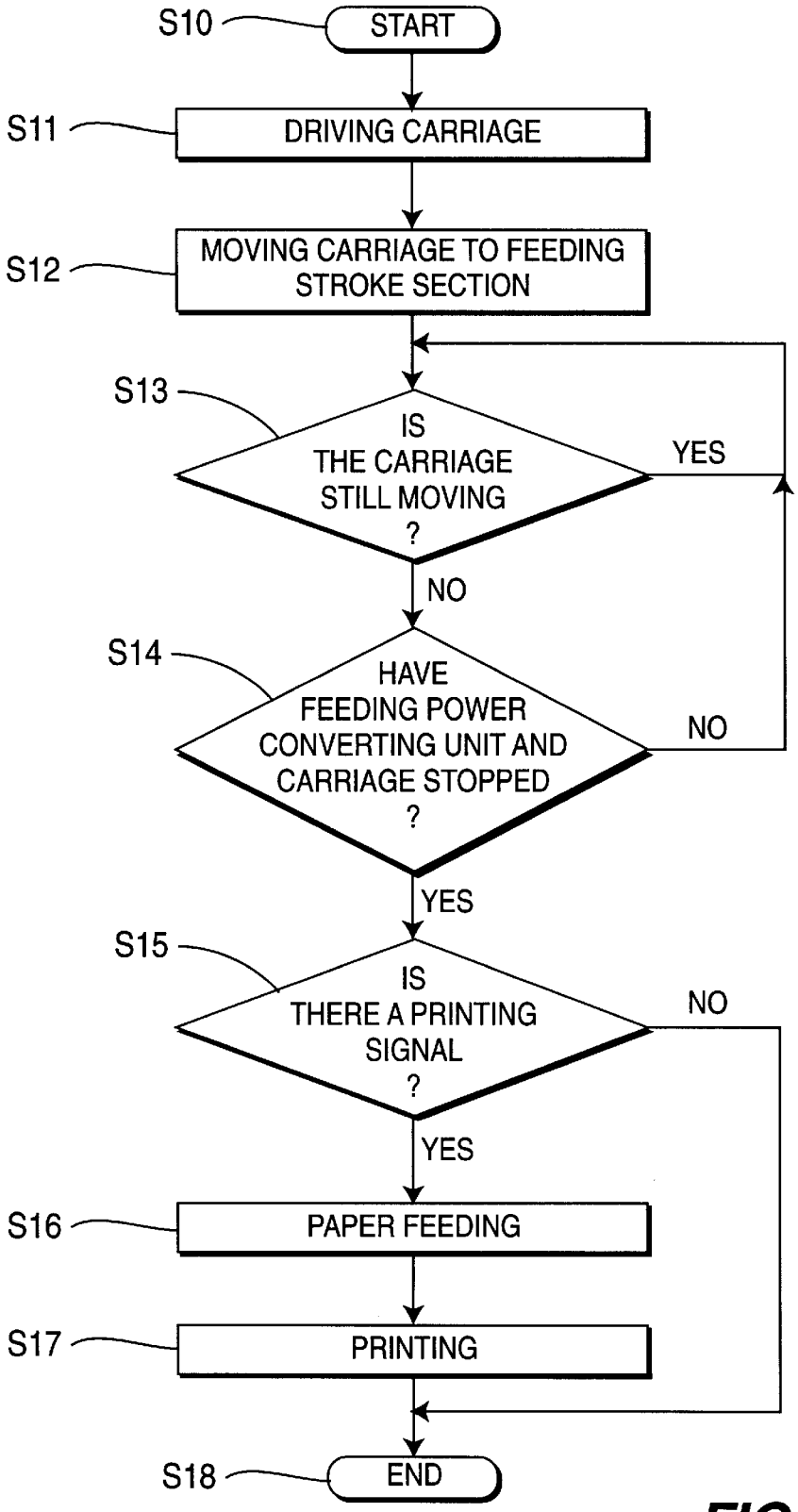
FIG. 11 is a flowchart schematically explaining a sheet feeding method according to the present invention.

FIG. 11 is a flowchart showing a sheet feeding method according to the present invention.

First of all, the carriage 2 is positioned at the right side of the printing stroke section in the beginning. If the feeding method according to the present invention is started (S10), the driving of the carriage 2 is started by the driving motor and the carriage 2 in which the ink-cartridge 1 is mounted is moved to the feeding stroke section (S12).

Therefore, the carriage 2 is moved to the left side along the guide shaft 4, while the position detecting sensor 11 detects the position of the carriage 2 by means of the encoder strip 10 and outputs the detecting signal to the main circuit.

The main circuit determines whether the carriage 2 is still moving (S13). If the carriage 2 is moving, the main circuit continues the movement of the carriage 2. If the carriage 2 is not moving, the main circuit determines whether the carriage lever 21 of the feeding power converting unit 20 is rotated. At this time, the rotation of the carriage lever 21 is determined by the position detecting of the carriage 2.

Further, the main circuit confirms the movement of the carriage 2 along with the rotation of the carriage lever 21 (S14), since the rotating distance of the carriage lever 21 varies with the volume of the loaded papers. That is, if the volume of the loaded papers is large, the rotating distance of the carriage lever 21 is small. On the contrary, if the volume of the loaded papers is small, the rotating distance of the carriage lever 21 is large.

Therefore, if the carriage 2 and the carriage lever 21 are stopped, it means that the first and second feeding pressures are applied to the loaded papers. At this time, the main circuit confirms whether there is any printing signal (15). If there is a printing signal. The main circuit drives the feeding roller 5 and performs the feeding operation (S16) and printing operation (S17) , and then ends the operation (S18).

Described as above, in the sheet feeding apparatus according to the present invention, since the movement of the carriage serves as a driving power source, it is possible to provide the feeding apparatus having a simple structure without any driving unit and decrease the manufacturing cost.

In addition, since the movement of the carriage as a driving power source can be controlled by the position detecting sensor and the encoder strip so that the feeding pressure is controlled in accordance with necessity, it is possible to provide a high feeding quality.

This invention has been described above with reference to the aforementioned embodiment. It is evident, however, that many alternative modifications and variations will be apparent to those having skill in the art in light of the foregoing description. Accordingly, the present invention embraces all such alternative modifications and variations as fall within the spirit and scope of the appended claims.

What is claimed is:

1. A sheet feeding apparatus for an image forming apparatus having a carriage with which an ink-carriage is mounted and which is reciprocated to print an image, the sheet feeding apparatus comprising;

a carriage;

a printing stroke section in which the carriage is reciprocated to print an image;

a feeding stroke section extended to one side of the printing stroke section and into which the carriage is moved whenever it is necessary to feed a new sheet;

a feeding power converting unit, disposed in a passage of the carriage in the feeding stroke section and rotated by being in contact with the carriage;

a crankshaft rotated in forward and reverse rotational directions corresponding to the rotational directions of the feeding power converting unit, said crankshaft having a left end and a right end;

a feeding roller extending parallel to the crankshaft, said feeding roller adapted for feeding a sheet of paper through the sheet feeding apparatus;

a paper loader disposed to bear a stack of printable media while successively exposing each sheet of the printable media to said feeding roller as the new sheet, said paper loader having one end which is rotatably disposed with respect to a hinge shaft which is apart from and faced with the crankshaft, and having another end which is a free end;

a left sheet feeding unit located at the left end of the crankshaft, and a right sheet feeding unit located at the right end of the crankshaft, the sheet feeding units adapted for raising said free end of said paper loader so as to generate a first feeding pressure against the feeding roller and forcibly pressing a presser for generating a second feeding pressure in order;

a position detecting sensor mounted on a rear face of the carriage;

an encoder strip so disposed as to be opposite to the position detecting sensor; and a main circuit that controls a movement of the carriage corresponding to a signal from the position detecting sensor.

2. The sheet feeding apparatus of claim 1, the feeding power converting unit comprising: a carriage lever having an upper end which is pushed by the carriage and is thus rotated; a driving bevel gear which is fixedly attached to a lower end of the carriage lever so as to be disposed rotatably along with the carriage lever, a driven bevel gear which is orthogonally engaged with the driving bevel gear so that a direction of the feeding power transmitted from the carriage can be converted orthogonally and which is directly coupled to the crankshaft.

3. The sheet feeding apparatus of claim 2, further comprising a gear housing for protecting the driving and driven bevel gears.

4. The sheet feeding apparatus of claim 1, each sheet feeding unit being provided with a pad housing disposed orthogonally to the crankshaft, and each pad housing having an elongated body part and a feeding motion part having a through aperture through which the crankshaft is disposed.

5. The sheet feeding apparatus of claim 4, one of the sheet feeding units being fixedly mounted on the crankshaft, and another of the sheet feeding units being a movable sheet feeding unit mounted on the crankshaft so as to be moved along the crankshaft to the left or right side, thereby adjusting a distance between the sheet feeding units according to a size of the sheet to be loaded.

6. The sheet feeding apparatus of claim 5, each of the pad housings having a pad housing aperture which is formed to be parallel with the crankshaft and through which an adjusting bar is disposed, the adjusting bar guiding the movement of the movable sheet feeding unit and fixing the movable sheet feeding unit at a desired position.

7. The sheet feeding apparatus of claim 6, the adjusting bar having a tooth part at an upper face thereof, and a stopper being disposed on an upper portion of a one of said pad housing apertures corresponding to the tooth part so as to be engaged with the tooth part of the adjusting bar, whereby the movable sheet feeding unit is fixed at a desired position.

8. The sheet feeding apparatus of claim 4, with said paper loader further comprising a knock-up plate for each pad housing mounted on the body part of the pad housing, the knock-up plate having one end being rotatably disposed with respect to the hinge shaft.

9. The sheet feeding apparatus of claim 8, further comprising a first pressing pad attached to a free end of each knock-up plate.

10. The sheet feeding apparatus of claim 9, with said paper loader further comprising a paper supporting member bearing the stack, disposed on both upper faces of each knock-up plate, the paper supporting member being fixed to one knock-up plate.

11. The sheet feeding apparatus of claim 8, with the feeding motion part of the pad housing being provided with a lever arm disposed to receive a rotational force from the crankshaft, and a lift lever rotatably disposed on the lever arm so as to lift up and down a free end of the knock-up plate in correspondence with the rotational direction of the crankshaft.

12. The sheet feeding apparatus of claim 11, further comprised of one of the sheet feeding units being fixedly mounted on the crankshaft, and another of the sheet feeding units being a movable sheet feeding unit mounted on the crankshaft so as to be moved along the crankshaft to the left or right side, the lever aim in the movable sheet feeding unit being disposed so as to be moved with the pad housing along the crankshaft.

13. The sheet feeding apparatus of claim 12, the lever arm having a rectangular aperture, and the crankshaft having a rectangular shape corresponding to the rectangular aperture of the lever arm.

14. The sheet feeding apparatus of claim 11, the lever arm having a hinge boss and a first protruded portion at the front and rear side thereof, the lift lever having a second protruded portion corresponding to the first protruded portion of the lever arm and a first pressing lever which lifts up and down the free end of the knock-up plate and a hinge shaft which is rotatable with respect to the hinge boss of the lever arm, and an elastic tension member being disposed between the first and second protruded portions.

15. The sheet feeding apparatus of claim 14, the elastic tension member comprising a tension spring.

16. The sheet feeding apparatus of claim 14, wherein the lift lever has a second pressing portion at the middle portion thereof, and said apparatus further comprises a pad holder disposed on the second pressing portion of the lift lever, the pad holder comprising an elevating member which is moved in a vertical direction so as to raise and lower the pad holder.

17. The sheet feeding apparatus of claim 16, further comprising guiding grooves for guiding the movement of the elevating member, the guiding grooves being disposed on each of both inner sides of the feeding motion part.

18. The sheet feeding apparatus of claim 17, the pad holder having a hinge shaft which is projected from both sides thereof and which is rotatably mounted on a slot of the feeding motion part, between the pad holder and the elevating member, and further comprising an elastic member for elastically supporting the pad holder.

19. The sheet feeding apparatus of claim 18, the pad holder being disposed so as to be tilted against the feeding roller, and the hinge shaft of the pad holder being disposed at the lower side part of the tilted pad holder so that, upon the elevating member being lowered, the pad holder is also rotated downward by its own self-weight.

20. The sheet feeding apparatus of claim 1, further comprising: a guiding roller for guiding a sheet fed by the feeding roller at one side of the feeding roller; a friction roller which is frictionally in contact with the feeding roller and lines up the fed paper; a paper detecting sensor for detecting the position of the fed paper; and a discharging roller for discharging a printed paper at the other side of the feeding roller.

21. The sheet feeding apparatus of claim 1, upon the first and second feeding pressures being released, the second feeding pressure is firstly released, and then the first feeding pressure is released in order.

22. The sheet feeding apparatus of claim 21, after the releasing of the first feeding pressure, the feeding roller being reversely rotated, and then the first feeding pressure is released.

23. A sheet feeding apparatus for an image forming apparatus having a carriage with which an ink-cartridge is mounted and which is reciprocated to print an image, the sheet feeding apparatus comprising:

a carriage;

a printing stroke section in which the carriage is reciprocated to print an image;

a feeding stroke section which is extended to one side of the printing stroke section and into which the carriage is moved whenever it is necessary to feed a new sheet;

a feeding power converting unit, disposed in a passage of the carriage in the feeding stroke section and rotated by being in contact with the carriage;

a crankshaft rotated in forward and reverse rotational directions corresponding to the rotational directions of the feeding power converting unit, said crankshaft having a left end and a right end;

a feeding roller extending parallel to the crankshaft, said feeding roller positioned to feed a sheet of paper through the sheet feeding apparatus;

a paper loader disposed to bear a stack of printable media while successively exposing each sheet of the printable media to said feeding roller as the new sheet, said paper loader having one end which is rotatably disposed with respect to a hinge shaft which is apart from the crankshaft, and having another end which is a free end;

a left sheet feeding unit located at the left end of the crankshaft, and a right sheet feeding unit located at the right end of the crankshaft, the sheet feeding units adapted for raising said free end of said paper loader so as to generate a first feeding pressure against the feeding roller and forcibly pressing a presser for generating a second feeding pressure in order;

a position detecting sensor mounted on the carriage;

an encoder strip so disposed as to be opposite to the position detecting sensor; and a main circuit that controls a movement of the carriage corresponding to a signal from the position detecting sensor;

said carriage being moved in a forward direction to the feeding stroke section whenever necessary to feed a new sheet from said paper loader, and during the reverse movement of the carriage, the carriage is firstly moved from an initial point of the reverse movement to a fraction of the entire length of the feeding stroke section, the carriage being stopped and then secondly moved to the printing stroke section.

24. A sheet feeding method for an image forming apparatus, the method comprising the steps of:

moving a carriage, in which an ink-cartridge is mounted, to a feeding stroke section;

detecting whether the carriage is still moving to the feeding stroke section;

determining whether a feeding power converting unit is being driven;

determining whether the movement of the carriage in the feeding stroke section is completely stopped;

determining whether there is a signal for a printing operation; and feeding a sheet and performing the printing operation.

25. The sheet feeding method of claim 24, said feeding power converting unit exhibiting rotation when driven the rotation of the feeding power converting unit and the movement of the carriage being determined by detecting the position of the carriage.

26. The sheet feeding method of claim 25, further comprised of detecting the position of the carriage with a position detecting sensor mounted on the rear face of the carriage and an encoder strip located opposite to the position detecting sensor, said position detecting sensor providing a detecting signal that is transmitted to a main circuit to control the movement of the carriage.

27. A sheet feeding process for an image forming apparatus, said process comprising:

moving a carriage in which an ink-cartridge is mounted, to a feeding stroke section;

detecting whether the carriage is still moving to the feeding stroke section;

determining whether a feeding power converter is being driven;

determining whether the movement of the carriage in the feeding stroke section is completely stopped;

determining whether there is a signal for a printing operation; and feeding a sheet of a printable medium while the carriage is in the feeding stroke section by converting the movement of the carriage into a force displacing the printable medium, and performing the printing operation by positioning the ink-cartridge to form an image on the sheet.

28. The process of claim 27, further comprised of determining occurrence of the movement of the carriage by detecting the position of the carriage.

29. The process of claim 28, further comprised of detecting the position of the carriage with a position detecting sensor mounted on the carriage and an encoder strip located opposite to the position detecting sensory said position detecting sensor providing a detecting signal that is transmitted to control the movement of the carriage.

30. A sheet feeding apparatus, comprising:

a tray disposed to bear a stack of printable media;

a carriage mounted to reciprocatingly travel through a printing stroke section where an image may be formed upon printable media within the stack, and a feeding stroke section extending from one side of said printing stroke section;

a feeding roller having an exterior surface spaced-apart from the stack in an alignment with said tray to feed the printable media from the stack seratim into said sheet feeding apparatus;

a sheet feeding mechanism comprised of a plate bearing said tray and having a distal end bearing a first pressing surface oriented to face said exterior surface, and a holder bearing a second pressing surface oriented to face said exterior surface of said feeding roller;

an articulated lift mechanism comprised of a first member moveably engaging said distal end and a second member resiliently engaging said holder; and a power converting unit comprising a carriage lever continuously located within said feeding stroke section to engage said carriage upon entry of said carriage within said feeding stroke section and be driven by movement of said carriage in a first direction within said feeding stroke section to drive said power converting unit to sequentially move said distal end bearing said first pressing surface to generate a first feeding pressure between a first sheet of the printable media within the stack and said feeding roller by placing the first sheet within the stack in an engagement with said exterior surface and then generating a second feeding pressure between the first sheet and said feeding roller by forcing said holder to place said second pressing surface in contact with the first sheet while said second pressing surface maintains the first sheet in engagement with said exterior surface as said feeding roller rotates said exterior surface with a feeding rotation.

31. The apparatus of claim 30, further comprised of said carriage controlling movement of said carriage lever as said carriage travels in a second and opposite direction, with said carriage lever driving said power converting unit to sequentially move said holder and said second pressing surface away from said exterior surface as said feeding roller reverses said feeding rotation of said exterior surface, and to then move said first pressing surface and the tray away from said feeding roller.

32. The apparatus of claim 31, with said lift mechanism comprising:

a lift lever having a distal end forming said first member and an intermediate section engaging said second member; and a lever arm mounted to rotate in response to movement of said carriage lever, said lever arm rotatably bearing said lift lever as said first pressing surface generates said first feeding pressure, and then lifting said lift lever as said lift lever urges said second member and said second pressing surface toward said exterior surface in response to farther displacement of said carriage lever by said movement of said carriage in said first direction.

33. The apparatus of claim 30, with said lift mechanism comprising:

a lift lever having a distal end forming said first member and an intermediate section engaging said second member; and a lever arm mounted to rotate in response to movement of said carriage lever said lever arm rotatably bearing said lift lever as said first pressing surface generates said first feeding pressure, and then lifting said lift lever as said lift lever urges said second member and said second pressing surface toward said exterior surface in response to farther displacement of said carriage lever by said movement of said carriage in said first direction.

34. A method for an ink jet printer printing image on media, comprising the steps of:

providing a media tray;

providing a printer carriage adapted to move from a first position to a second position and back to the first position;

providing a movable lever connected to said media tray such that said media tray is moved when said lever is moved;

moving said printer carriage;

contacting said lever with said carriage and thereby moving said media tray from a fist position to a second position; and controlling movement of said carriage with a controller.

35. An apparatus for an ink jet printer, comprising:

a media tray;

a printhead;

a carriage mounted for movement from a first position to a second position and then to a third position and thereafter back to said first position;

a movable lever connected to said media tray such that said media tray is moved when said lever is moved;

a motor for moving said carriage, said carriage being adapted to contact said lever and thereby move said media tray from a first position to a second position; and a controller for controlling movement of said carriage.

36. The apparatus of claim 35, including a link member connected to said movable lever and adapted to push against said media tray when said carriage is moved to said second position.

37. The apparatus of claim 36, wherein said link member is adapted to move away said media in said media tray downward when said carriage is moved to said third position.

* * * * *